US007722394B2

(12) United States Patent
Feldman et al.

(10) Patent No.: US 7,722,394 B2
(45) Date of Patent: May 25, 2010

(54) ELECTRICAL TERMINATION DEVICE

(75) Inventors: Steven Feldman, Cedar Park, TX (US); Joseph N. Castiglione, Cedar Park, TX (US); Rudy L. Densmore, Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 12/035,234

(22) Filed: Feb. 21, 2008

(65) Prior Publication Data

US 2009/0221180 A1 Sep. 3, 2009

(51) Int. Cl.
*H01R 9/05* (2006.01)

(52) U.S. Cl. ..... 439/578; 439/607.01

(58) Field of Classification Search ..... 439/578, 439/610, 394, 607.1
See application file for complete search history.

(56) References Cited

U.S. PATENT DOCUMENTS

| | | | | |
|---|---|---|---|---|
| 5,046,960 | A | 9/1991 | Fedder | |
| 5,063,659 | A | 11/1991 | Wright | |
| 5,116,230 | A | 5/1992 | Dechelette et al. | |
| 5,184,965 | A | 2/1993 | Myschik et al. | |
| 5,194,020 | A | 3/1993 | Voltz | |
| 5,222,898 | A | 6/1993 | Fedder et al. | |
| 5,431,578 | A | 7/1995 | Wayne | |
| 5,554,050 | A | 9/1996 | Marpoe, Jr. | |
| 5,647,766 | A | 7/1997 | Nguyen | |
| 5,766,036 | A | 6/1998 | Ahmad et al. | |
| 5,938,476 | A | 8/1999 | Wu et al. | |
| 5,964,621 | A | 10/1999 | Wolla et al. | |
| 5,975,950 | A * | 11/1999 | Yamaguchi | 439/585 |
| 6,146,202 | A | 11/2000 | Ramey et al. | |
| 6,203,369 | B1 | 3/2001 | Feldman | |
| 6,231,391 | B1 | 5/2001 | Ramey et al. | |
| 6,257,931 | B1 * | 7/2001 | Sakurai et al. | 439/607.5 |
| 6,368,120 | B1 | 4/2002 | Scherer et al. | |

(Continued)

FOREIGN PATENT DOCUMENTS

DE 4116166 C1 7/1992

(Continued)

OTHER PUBLICATIONS

U.S. Provisional Application entitled "Electrical Connector Assembly", filed Oct. 17, 2007, having U.S. Appl. No. 60/980,512.

*Primary Examiner*—Edwin A. Leon
*Assistant Examiner*—Vanessa Girardi
(74) *Attorney, Agent, or Firm*—Johannes P. M. Kusters

(57) ABSTRACT

An electrical termination device includes an electrically conductive shield element, an insulator disposed within the shield element, and one or more electrical contacts supported within and electrically isolated from the shield element by the insulator. The insulator includes one or more first keying elements configured to orient and retain the one or more electrical contacts in the insulator. The one or more first keying elements may be configured to prevent the one or more electrical contacts from rotating in the insulator when the one or more electrical contacts and the insulator are in a correctly assembled configuration, and prevent assembly of the insulator into an electrically conductive shield element when the one or more electrical contacts are incorrectly oriented in the insulator. The electrical termination device may be included in an electrical connector.

23 Claims, 5 Drawing Sheets

U.S. PATENT DOCUMENTS

| | | | | |
|---|---|---|---|---|
| 6,371,813 | B2 | 4/2002 | Ramey et al. | |
| 6,498,506 | B1 | 12/2002 | Beckous | |
| 6,524,135 | B1 | 2/2003 | Feldman et al. | |
| 6,533,609 | B2 | 3/2003 | Koide | |
| 6,540,565 | B2 | 4/2003 | Babel et al. | |
| 6,688,920 | B2 | 2/2004 | Lehner et al. | |
| 6,743,050 | B1 | 6/2004 | Wu | |
| 6,764,350 | B2 * | 7/2004 | Kosmala | 439/752 |
| 6,780,068 | B2 | 8/2004 | Bartholoma et al. | |
| 6,824,427 | B1 | 11/2004 | Feldman et al. | |
| 6,830,480 | B2 | 12/2004 | Yoshioka | |
| 6,849,799 | B2 | 2/2005 | Springer et al. | |
| 6,929,507 | B2 | 8/2005 | Lin | |
| 6,971,916 | B2 | 12/2005 | Tokunaga | |
| 7,021,963 | B2 * | 4/2006 | Feldman | 439/578 |
| 7,044,789 | B2 * | 5/2006 | Yohn et al. | 439/599 |
| 7,134,911 | B2 * | 11/2006 | Bernhart et al. | 439/587 |
| 7,331,821 | B2 * | 2/2008 | Feldman | 439/578 |
| 2002/0028607 | A1 | 3/2002 | Babel et al. | |
| 2005/0054237 | A1 | 3/2005 | Gladd et al. | |
| 2006/0128216 | A1 | 6/2006 | Feldman | |
| 2007/0197095 | A1 | 8/2007 | Feldman et al. | |
| 2008/0020615 | A1 * | 1/2008 | Feldman et al. | 439/162 |

FOREIGN PATENT DOCUMENTS

| | | | |
|---|---|---|---|
| EP | 0 570 181 | A2 | 11/1993 |
| JP | 8096864 | A | 4/1996 |
| JP | 10335008 | | 12/1998 |
| JP | 11074037 | A | 3/1999 |
| JP | 200040563 | | 2/2000 |
| JP | 2000-067980 | | 3/2000 |
| JP | 2002319458 | A | 10/2002 |
| JP | 2002334764 | | 11/2002 |
| WO | WO 2006/120373 | A2 | 11/2006 |

* cited by examiner

ELECTRICAL TERMINATION DEVICE

TECHNICAL FIELD

The present invention relates to high speed electrical connectors. In particular, the present invention relates to electrical termination devices that can be used in these high speed electrical connectors to facilitate high signal line density and shielded controlled impedance (SCI) for the signal lines.

BACKGROUND

Interconnection of integrated circuits to other circuit boards, cables or electronic devices is known in the art. Such interconnections typically have not been difficult to form, especially when the signal line densities have been relatively low, and when the circuit switching speeds (also referred to as edge rates or signal rise times) have been slow when compared to the length of time required for a signal to propagate through a conductor in the interconnect or in the printed circuit board. As user requirements grow more demanding with respect to both interconnect sizes and circuit switching speeds, the design and manufacture of interconnects that can perform satisfactorily in terms of both physical size and electrical performance has grown more difficult.

Connectors have been developed to provide the necessary impedance control for high speed circuits, i.e., circuits with a transmission frequency of at least 5 GHz. Although many of these connectors are useful, there is still a need in the art for connector designs having increased signal line densities with closely controlled electrical characteristics to achieve satisfactory control of the signal integrity.

SUMMARY

In one aspect, the present invention provides an electrical termination device including an electrically conductive shield element, an insulator disposed within the shield element, and one or more electrical contacts. The one or more electrical contacts are supported within and electrically isolated from the shield element by the insulator, and are configured for making electrical connections through a front end and back end of the shield element. The insulator includes one or more first keying elements configured to orient and retain the one or more electrical contacts in the insulator.

In another aspect, the present invention provides an electrical connector including an electrical cable, one or more electrical contacts, an insulator disposed around the one or more electrical contacts, and an electrically conductive shield element. The electrical cable includes one or more conductors and a ground shield surrounding the one or more conductors. The one or more electrical contacts are connected to the one or more conductors. The electrically conductive shield element is disposed around the insulator and connected to the ground shield. The insulator includes one or more first keying elements configured to orient and retain the one or more electrical contacts in the insulator.

In another aspect, the present invention provides an insulator having one or more first keying elements configured to orient and retain one or more electrical contacts in the insulator and configured to prevent assembly of the insulator into an electrically conductive shield element when the one or more electrical contacts are incorrectly oriented in the insulator. The one or more first keying elements may be configured to prevent the one or more electrical contacts from rotating in the insulator when the one or more electrical contacts and the insulator are in a correctly assembled configuration.

The above summary of the present invention is not intended to describe each disclosed embodiment or every implementation of the present invention. The Figures and detailed description that follow below more particularly exemplify illustrative embodiments.

DETAILED DESCRIPTION

In the following detailed description of the preferred embodiments, reference is made to the accompanying drawings that form a part hereof. The accompanying drawings show, by way of illustration, specific embodiments in which the invention may be practiced. It is to be understood that other embodiments may be utilized, and structural or logical changes may be made without departing from the scope of the present invention. The following detailed description, therefore, is not to be taken in a limiting sense, and the scope of the invention is defined by the appended claims.

Figure 1:
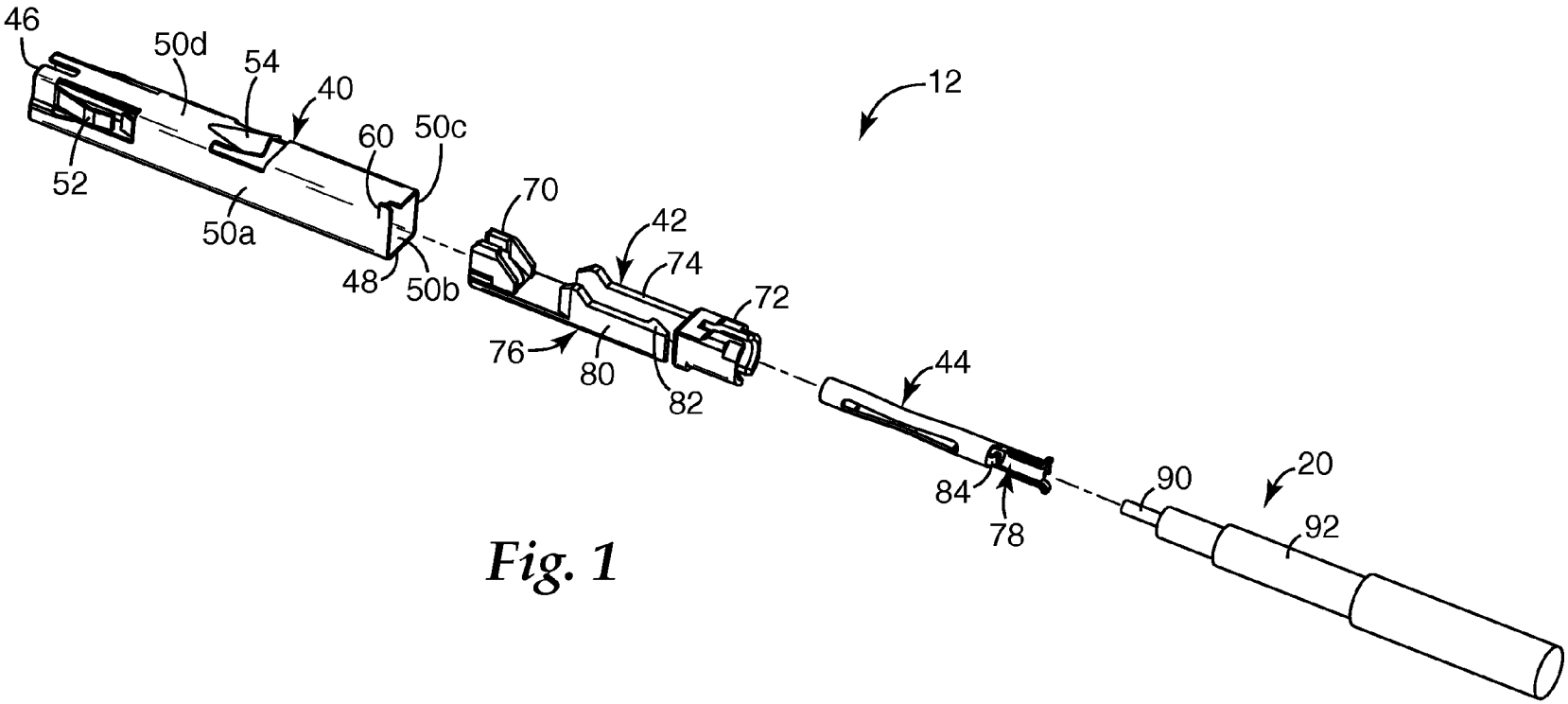
FIG. 1 is an exploded perspective view of an exemplary embodiment of an electrical termination device according to an aspect of the present invention.
Figures 2A, 2B, 2C, 2D:
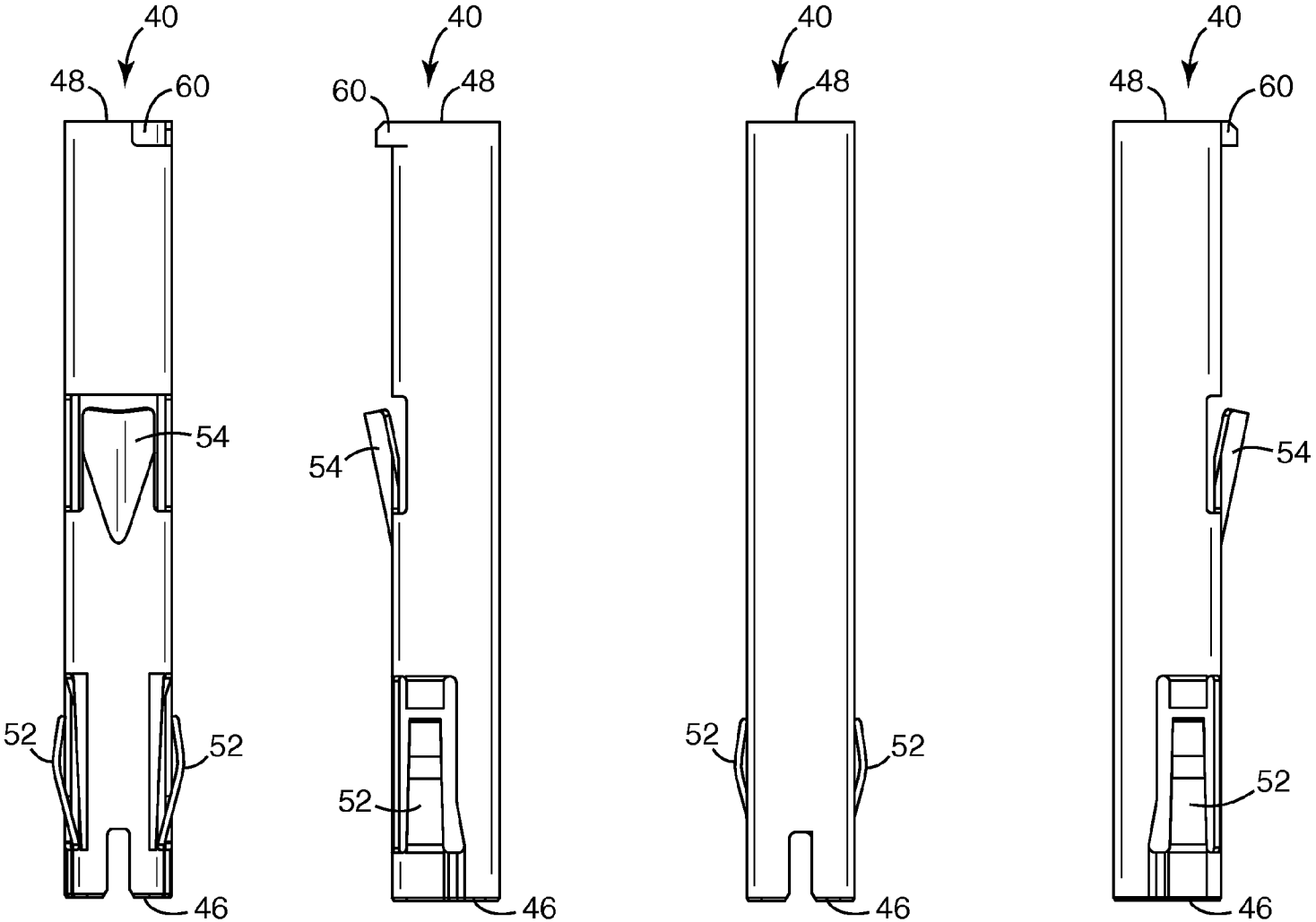
FIGS. 2A-2D are plan views of the shield element of the electrical termination device of FIG. 1.

FIGS. 1-5 illustrate an exemplary embodiment of an electrical termination device 12 according to an aspect of the present invention. FIG. 1 shows an exploded view of the exemplary electrical termination device 12 used with an electrical cable 20, while FIGS. 2-5 provide detailed views of the individual components of an electrical termination device according to an aspect of the present invention. Electrical termination device 12 includes a longitudinal electrically conductive shield element 40, an insulator 42, and a single electrical contact 44. Insulator 42 electrically isolates electrical contact 44 from conductive shield element 40.

Referring to FIGS. 1 and 2A-2D, electrically conductive shield element 40 has a front end 46, a back end 48, and side surfaces 50*a*-50*d* (collectively referred to herein as "sides 50") defining a non-circular transverse cross-section. Although the illustrated embodiment includes four sides 50 defining a substantially square transverse cross-section, shield element 40 may have other numbers of sides defining other generally rectangular or non-circular transverse cross-sections. In other embodiments, shield element 40 may have a generally curvilinear (such as, e.g., a circular) transverse cross-section. As illustrated, shield element 40 includes laterally protruding resilient ground contact beams 52 disposed on opposed side surfaces 50*a* and 50*c*. In other embodiments, shield element 40 includes only a single ground contact beam 52. A latch member 54 extends from at least one of sides 50. Latch member 54 is configured to retain termination device 12 in a retainer or organizer plate (not shown) configured to receive, secure, and manage a plurality of electrical termination devices. In one embodiment, latch member 54 is designed to yield (i.e., deform) at a lower force than required to break the attached electrical cable 20, so that an electrical termination device 12 can be pulled out of the retainer or organizer plate for the purpose of replacing or repairing an individual electrical termination device and cable assembly. In the illustrated embodiment of FIG. 1, latch member 54 is shown on a different side 50*d* as one of ground contact beams 52. However, in other embodiments, latch member 54 may additionally, or alternatively, be positioned on a side 50 of the shield element 40 that includes a ground contact beam 52 (FIGS. 2A-2D). Shield element 40 may further include a keying member, in the form of tab 60, laterally extending from back end 48 of shield element 40. Tab 60 is configured to ensure that electrical termination device 12 is inserted into the retainer or organizer plate in the correct predetermined orientation. If electrical termination device 12 is not properly oriented within the retainer or organizer plate, electrical termination device 12 cannot be fully inserted. In one embodiment, tab 60 is deformable (such as by the use of a tool or the application of excess force in the insertion direction) and may be straightened to allow a damaged or defective electrical termination device 12 to be pushed completely through the retainer or organizer plate, such that the damaged or defective components can be replaced or repaired. Although the figures show that shield element 40 includes ground contact beams 52, it is within the scope of the present invention to use other contact element configurations, such as Hertzian bumps, in place of the contact beams 52.

Referring now to FIGS. 1 and 3A-3I, insulator 42 according to an aspect of the present invention includes a first insulative member 70 disposed within shield element 40 adjacent front end 46, and a second insulative member 72 disposed within shield element 40 adjacent back end 48. First and second insulative members 70, 72 are configured to provide structural support to insulator 42. In this embodiment, a spacer bar 74 is provided that properly positions and spaces first and second insulative members 70, 72 with respect to each other. The first and second insulative members 70, 72 and spacer bar 74 are shaped to receive an electrical contact 44 and are configured for slidable insertion into shield element 40, such that electrical contact 44 lies substantially parallel to a longitudinal axis of shield element 40. The first and second insulative members 70, 72 and spacer bar 74 are configured to guide electrical contact 44 during its insertion into insulator 42. In this configuration, electrical termination device 12 can serve as a coaxial electrical termination device, whereby electrical contact 44 can be connected, e.g., to a single coaxial cable.

In another embodiment, one or more spacer bars 74 are shaped to receive two electrical contacts 44 and are configured for slidable insertion into shield element 40, such that two electrical contacts 44 lie substantially parallel to a longitudinal axis of shield element 40. One or more spacer bars 74 are configured to guide two electrical contacts 44 during their insertion into insulator 42. In this configuration, electrical termination device 12 can serve as a twinaxial electrical termination device, whereby two electrical contacts 44 can be connected, e.g., to a single twinaxial cable.

Insulator 42 further includes a first keying element 76 configured to orient and retain electrical contact 44 in insulator 42. In one aspect, retaining electrical contact 44 in insulator 42 prevents substantial movement of electrical contact 44 in a direction substantially parallel to a longitudinal axis of electrical contact 44. In one embodiment, electrical contact 44 includes a second keying element 78 configured to engage with first keying element 76 when electrical contact 44 and insulator 42 are in a correctly assembled configuration. First keying element 76 may be configured to prevent electrical contact 44 from rotating in insulator 42 when electrical contact 44 and insulator 42 are in a correctly assembled configuration.

In a preferred embodiment, spacer bar 74 and first keying element 76 are shaped and positioned relative to one or more electrical contacts 44 and shield element 40 such that air is the major dielectric material surrounding one or more electrical contacts 44, so as to lower the effective dielectric constant of electrical termination device 12 and thereby lower the characteristic impedance of the electrical termination device and cable assembly closer to the desired target value, such as, for example, 50 ohms.

Figure 3D:
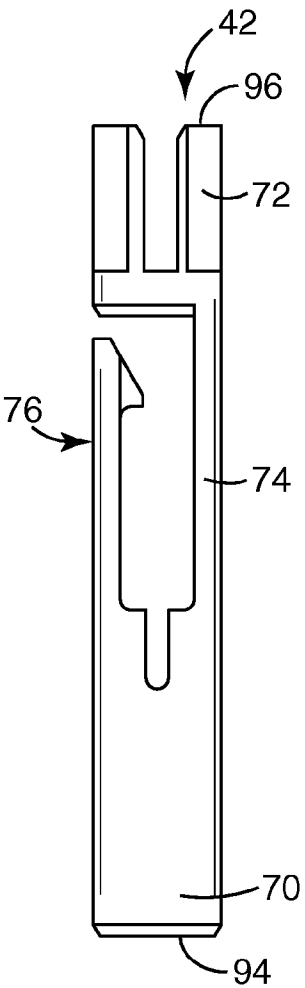
FIGS. 3A-3I are plan and cross-sectional views of the insulator of the electrical termination device of FIG. 1.
Figure 3C:
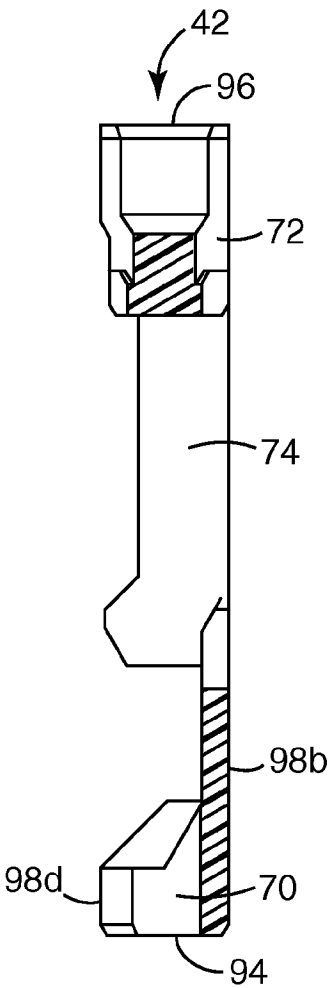
Figure 3B:
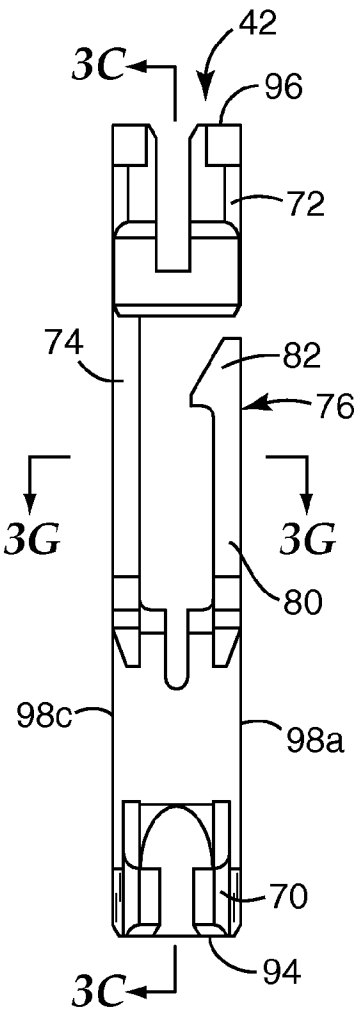
Figure 3A:
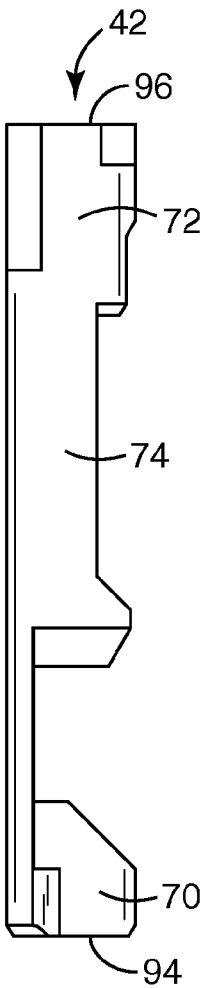
Figure 3F:
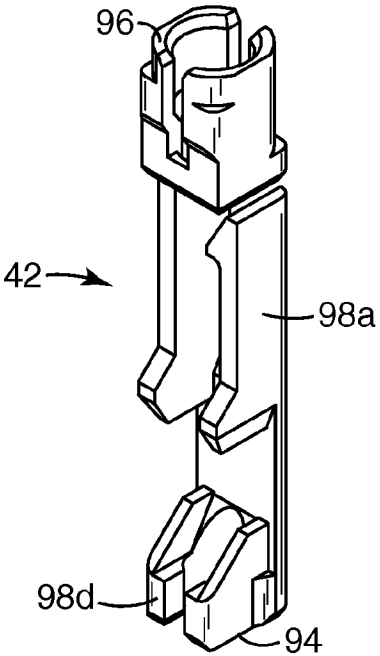
Figure 3I:
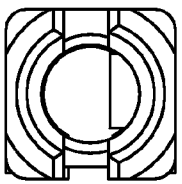
Figure 3H:
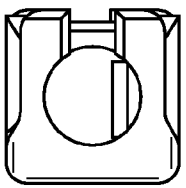
Figure 3E:
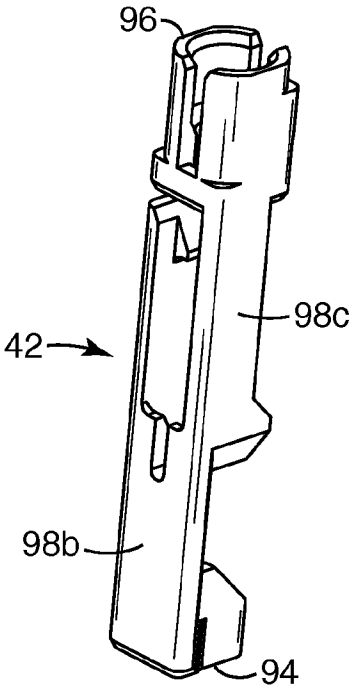
Figure 3G:
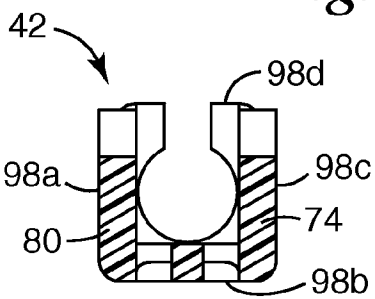

In the embodiment illustrated in FIG. 1, first keying element 76 extends from insulative member 70 (as best seen in FIG. 3D) and includes a resilient beam 80, and a male key portion 82 positioned at an end of resilient beam 80. As can best be seen in FIG. 5, male key portion 82 engages with a female key portion 84 of second keying element 78 of electrical contact 44 to properly position, orient and retain electrical contact 44 in insulator 42. As electrical contact 44 is inserted into insulator 42, first keying element 76 with resilient beam 80 and male key portion 82 deflects outwardly (away from electrical contact 44) until engaging with female key portion 84. Beneficially, if electrical contact 44 is incorrectly oriented or improperly assembled into insulator 42 (i.e., such that male key portion 82 is not aligned or engaged with female key portion 84, the presence of male key portion 82 will cause first keying element 76 to remain deflected outwardly such that insulator 42 will not fit in shield element 40, thereby preventing the installation and use of an improperly assembled electrical termination device 12. Although in the embodiment of FIG. 1 first keying element 76 includes male key portion 82 and second keying element 78 includes female key portion 84 configured to receive male key portion 82, in other embodiments, the proper positioning, orienting, and retaining, as well as preventing rotation of contact 44, may be accomplished by alternative embodiments of first keying element 76 and second keying element 78. For example, second keying element 78 may include a male key portion and first keying element 76 may include a female key portion configured to receive the male key portion. In another example, first keying element 76 and second keying element 78 may include reciprocal key portions that, for example, include both male and female features. In alternative embodiments, insulator 42 may include two or more first keying elements 76 configured to orient and retain one or more electrical contacts 44 in insulator 42. In other embodiments, first keying element 76 of insulator 42 may include a resilient beam 80 that spans between insulative member 70 and insulative member 72 of insulator 42.

Still referring to FIGS. 1 and 3A-3I, insulator 42 has a front end 94, a back end 96, and outer surfaces 98*a*-98*d* (collectively referred to herein as "outer surface 98") defining a non-circular shape. Although the illustrated embodiment includes an outer surface 98 defining a substantially square shape, insulator 42 may have an outer surface 98 defining other suitable shapes, including generally rectangular, non-circular, or curvilinear (such as, e.g., circular) shapes.

Insulator 42 can be formed of any suitable material, such as, e.g., a polymeric material, by any suitable method, such as, e.g., injection molding, machining, or the like.

In one embodiment, insulator 42 and one or more first keying elements 76 may be monolithic. For example, insulator 42 and first keying elements 76 may be injection molded as a monolithic structure. In another embodiment, insulator 42 and one or more first keying elements 76 may comprise separate elements, assembled by any suitable method or structure, including but not limited to snap fit, friction fit, press fit, mechanical clamping, and adhesive. For example, insulator 42 may be injection molded and one or more first keying elements 76 may be machined and assembled to insulator 42 by press fit.

Figure 5:
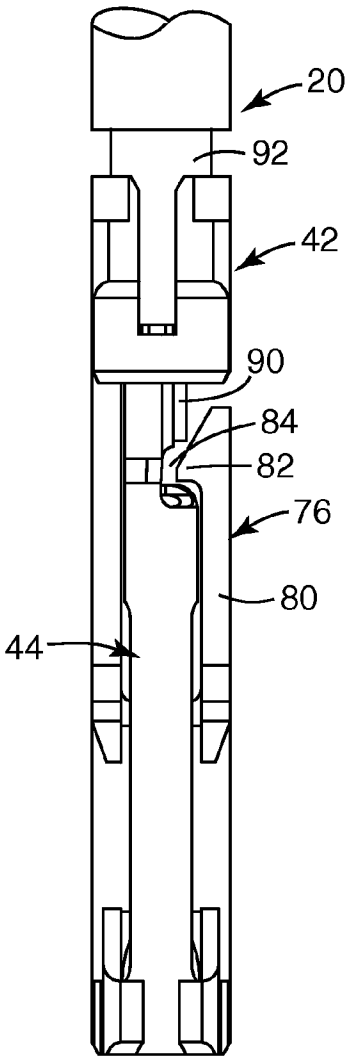
FIG. 5 is a plan view of the electrical contact and the insulator of the electrical termination device of FIG. 1 used with an electrical cable in an assembled configuration.
Figure 4C:
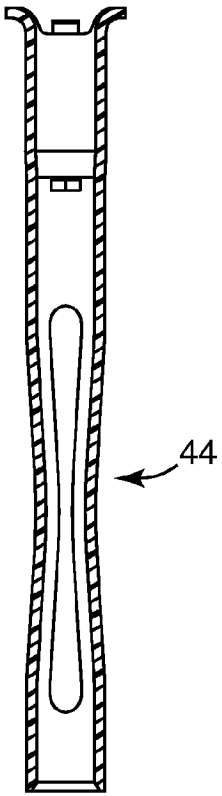
FIGS. 4A-4C are plan and cross-sectional views of the electrical contact of the electrical termination device of FIG. 1.
Figure 4B:
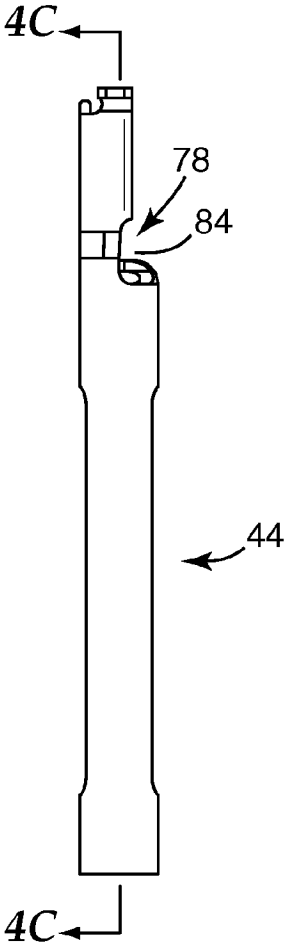
Figure 4A:
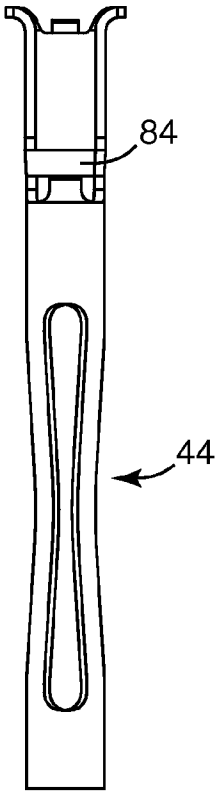

In one embodiment, electrical termination device 12 is configured for termination of an electrical cable 20, such that a conductor 90 of electrical cable 20 is attached to electrical contact 44 and ground shield 92 of electrical cable 20 is attached to shield element 40 of electrical termination device 12 using conventional means, such as soldering. The type of electrical cable used in an aspect of the present invention can be a single wire cable (e.g., single coaxial or single twinaxial) or a multiple wire cable (e.g., multiple coaxial, multiple twinaxial, or twisted pair). In one embodiment, prior to attaching one or more electrical contacts 44 to one or more conductors 90 of electrical cable 20, ground shield 92 is stiffened by a solder dip process. After one or more electrical contacts 44 are attached to one or more conductors 90, the one or more electrical contacts 44 are slidably inserted into insulator 42. The prepared end of electrical cable 20 and insulator 42 are configured such that the stiffened ground shield 92 bears against back end 96 of insulator 42 prior to one or more electrical contacts 44 being fully seated against front end 94 of insulator 42. Thus, when insulator 42 (having one or more electrical contacts 44 therein) is next slidably inserted into shield element 40, the stiffened ground shield 92 acts to push insulator 42 into shield element 40, and one or more electrical contacts 44 are prevented from pushing against insulator 42 in the insertion direction. In this manner, one or more electrical contacts 44 are prevented from being pushed back into electrical cable 20 by reaction to force applied during insertion of insulator 42 into shield element 40, which may prevent proper connection of one or more electrical contacts 44 with a header. In one embodiment, and as can be seen in FIG. 5, conductor 90 of electrical cable 20, once attached to electrical contact 44, provides additional structure to female key portion 84 of second keying element 78 of electrical contact 44 to help retain electrical contact 44 in insulator 42.

In one embodiment, electrical termination device 12 includes two electrical contacts 44 and is configured for termination of an electrical cable 20 including two conductors 90. Each conductor 90 of electrical cable 20 is connected to an electrical contact 44 of electrical termination device 12, and ground shield 92 of electrical cable 20 is attached to shield element 40 of electrical termination device 12 using conventional means, such as soldering. The type of electrical cable used in this embodiment can be a single twinaxial cable.

In each of the embodiments and implementations described herein, the various components of the electrical termination device and elements thereof are formed of any suitable material. The materials are selected depending upon the intended application and may include both metals and non-metals (e.g., any one or combination of non-conductive materials including but not limited to polymers, glass, and ceramics). In one embodiment, insulator 42 is formed of a polymeric material by methods such as injection molding, extrusion, casting, machining, and the like, while the electrically conductive components are formed of metal by methods such as molding, casting, stamping, machining, and the like. Material selection will depend upon factors including, but not limited to, chemical exposure conditions, environmental exposure conditions including temperature and humidity conditions, flame-retardancy requirements, material strength, and rigidity, to name a few.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the mechanical, electromechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An electrical termination device comprising:

an electrically conductive shield element having a front end and a back end;

an insulator disposed within the shield element and comprising:

a first insulative member disposed adjacent the front end of the shield element;

a second insulative member disposed adjacent the back end of the shield element;

one or more insulative spacer bars longitudinally extending between the first and second insulative members; and one or more first keying elements positioned between the first and second insulative members; and one or more electrical contacts supported within and electrically isolated from the shield element by the insulator, the one or more electrical contacts configured for making electrical connections through the front end and back end of the shield element, wherein the first and second insulative members circumferentially support the one or more electrical contacts, and wherein the one or more first keying elements are configured to orient and retain the one or more electrical contacts in the insulator.

2. The electrical termination device of claim 1, wherein the one or more first keying elements comprise a resilient beam.

3. The electrical termination device of claim 1, wherein the one or more first keying elements extend from at least one of the first and second insulative members of the insulator.

4. The electrical termination device of claim 1, wherein the one or more first keying elements are configured to prevent the one or more electrical contacts from rotating in the insulator when the one or more electrical contacts and the insulator are in a correctly assembled configuration.

5. The electrical termination device of claim 1, wherein the one or more spacer bars and the one or more first keying elements are positioned relative to the one or more electrical contacts such that air is the major dielectric material surrounding the one or more electrical contacts.

6. The electrical termination device of claim 1, wherein the one or more electrical contacts include an outer surface defining a generally curvilinear shape, and wherein the insulator includes an inner surface defining a generally rectangular shape.

7. The electrical termination device of claim 1, wherein the one or more first keying elements are disposed in a termination portion of the one or more electrical contacts when the one or more electrical contacts and the insulator are in a correctly assembled configuration.

8. The electrical termination device of claim 1, wherein the one or more electrical contacts comprise a second keying element configured to engage with a first keying element when the one or more electrical contacts and the insulator are in a correctly assembled configuration.

9. The electrical termination device of claim 8, wherein the one or more first keying elements comprise a male key portion and the second keying element comprises a female key portion configured to receive the male key portion.

10. The electrical termination device of claim 8, wherein the second keying element comprises a male key portion and the one or more first keying elements comprise a female key portion configured to receive the male key portion.

11. The electrical termination device of claim 8, wherein the one or more first keying elements and the second keying element comprise reciprocal key portions.

12. An electrical connector comprising:

an electrical cable including one or more conductors and a ground shield surrounding the one or more conductors;

one or more electrical contacts connected to the one or more conductors;

an insulator disposed around the one or more electrical contacts; and an electrically conductive shield element disposed around the insulator and connected to the ground shield, the shield element having a front end and a back end, wherein the insulator comprises:

a first insulative member disposed adjacent the front end of the shield element;

a second insulative member disposed adjacent the back end of the shield element;

one or more insulative spacer bars longitudinally extending between the first and second insulative members; and one or more first keying elements positioned between the first and second insulative members and configured to orient and retain the one or more electrical contacts in the insulator, and wherein the first and second insulative members circumferentially support the one or more electrical contacts.

13. An insulator comprising:

first and second insulative members configured to circumferentially support one or more electrical contacts;

one or more insulative spacer bars longitudinally extending between the first and second insulative members; and one or more first keying elements positioned between the first and second insulative members, configured to orient and retain the one or more electrical contacts in the insulator, and configured to prevent assembly of the insulator into an electrically conductive shield element when the one or more electrical contacts are incorrectly oriented in the insulator.

14. The insulator of claim 13, wherein the insulator includes an outer surface defining a generally rectangular shape.

15. The insulator of claim 13, wherein the insulator includes an outer surface defining a generally curvilinear shape.

16. The insulator of claim 13, wherein the insulator is formed by at least one of injection molding and machining.

17. The insulator of claim 13, wherein the one or more first keying elements extend from at least one of the first and second insulative members of the insulator.

18. The insulator of claim 13, wherein the insulator and one or more first keying elements are monolithic.

19. The insulator of claim 13, wherein the one or more first keying elements are configured to prevent the one or more electrical contacts from rotating in the insulator when the one or more electrical contacts and the insulator are in a correctly assembled configuration.

20. The insulator of claim 13, wherein the one or more spacer bars are configured to resiliently deflect during assembly of the one or more electrical contacts and the insulator.

21. The insulator of claim 13, wherein the one or more first keying elements comprise a resilient beam.

22. The insulator of claim 21, wherein the resilient beam spans longitudinally between the first and second insulative members of the insulator.

23. The insulator of claim 21, wherein the resilient beam is positioned opposite the one or more spacer bars.

* * * * *

UNITED STATES PATENT AND TRADEMARK OFFICE

CERTIFICATE OF CORRECTION

PATENT NO. : 7,722,394 B2
APPLICATION NO. : 12/035234
DATED : May 25, 2010
INVENTOR(S) : Steven Feldman et al.

It is certified that error appears in the above-identified patent and that said Letters Patent is hereby corrected as shown below:

Column 6,
Lines 6-7, delete "electromechanical" and insert --electro-mechanical-- therefor.

Signed and Sealed this
First Day of March, 2011

David J. Kappos

David J. Kappos
*Director of the United States Patent and Trademark Office*